US009173014B2

(12) United States Patent
Park

(10) Patent No.: US 9,173,014 B2
(45) Date of Patent: Oct. 27, 2015

(54) SPEAKER APPARATUS PROVIDING WITH VISUAL SCREEN

(75) Inventor: Seung-Min Park, Seoul (KR)

(73) Assignee: THE KOREA DEVELOPMENT BANK, Seoul (KR)

( * ) Notice: Subject to any disclaimer, the term of this patent is extended or adjusted under 35 U.S.C. 154(b) by 1705 days.

(21) Appl. No.: 12/311,137

(22) PCT Filed: Sep. 12, 2007

(86) PCT No.: PCT/KR2007/004398

§ 371 (c)(1),
(2), (4) Date: Mar. 18, 2009

(87) PCT Pub. No.: WO2008/035878

PCT Pub. Date: Mar. 27, 2008

(65) Prior Publication Data

US 2010/0039355 A1 Feb. 18, 2010

(30) Foreign Application Priority Data

Sep. 22, 2006 (KR) ..... 10-2006-0092238

(51) Int. Cl.

| | |
|---|---|
| ***G09G 3/30*** | (2006.01) |
| ***H04R 1/02*** | (2006.01) |
| ***H04R 7/12*** | (2006.01) |

(52) U.S. Cl.

CPC ..... *H04R 1/028* (2013.01); *H04R 7/12* (2013.01); *H04R 2499/15* (2013.01)

(58) Field of Classification Search

USPC ..... 345/76

See application file for complete search history.

(56) References Cited

U.S. PATENT DOCUMENTS

| | | | | |
|---|---|---|---|---|
| 2006/0012559 | A1 * | 1/2006 | Kang | 345/108 |
| 2007/0137463 | A1 * | 6/2007 | Lumsden | 84/603 |

FOREIGN PATENT DOCUMENTS

| | | | | |
|---|---|---|---|---|
| JP | 09-065466 | | 3/1997 | |
| JP | 2001-095074 | A * | 4/2001 | H04R 1/00 |
| JP | 2005-252424 | | 9/2005 | |
| KR | 10-2006-0006630 | A | 1/2006 | |
| WO | WO 2007023409 | A2 * | 3/2007 | |

OTHER PUBLICATIONS

International Search Report dated Jan. 8, 2008.

* cited by examiner

*Primary Examiner* — Grant Sitta
*Assistant Examiner* — Kirk Hermann
(74) *Attorney, Agent, or Firm* — Flynn, Thiel, Boutell & Tanis, P.C.

(57) ABSTRACT

A speaker apparatus having a video screen function is disclosed, in which a cone paper of a conventional speaker is substituted with a flexible OLED for thereby displaying various images and video sources in sync with an audio source. A flexible OLED is provided for displaying a video source and an externally upgraded video source in a speaker apparatus which comprises a sound output apparatus having a sound coil, a magnet, and a damper, and an electric circuit apparatus of the sound output apparatus.

7 Claims, 5 Drawing Sheets

SPEAKER APPARATUS PROVIDING WITH VISUAL SCREEN

TECHNICAL FIELD

The present invention relates to a speaker apparatus with a video screen function, and in particular to a speaker apparatus able to display various images (visualization) and video sources in which a cone paper of a conventional speaker is substituted with a flexible OLED (Organic Light Emitting Device) for thereby displaying various images and video sources.

BACKGROUND ART

A conventional speaker is basically provided with a function for outputting sound or high and low sound levels depending on a user's preference. In a Karaoke room equipped with an accompaniment machine, a user sings a song along with the accompaniment outputted through a speaker, while watching a monitor screen, which displays a background image along with lyrics.

However, in the conventional art, since a monitor and a speaker are separately installed in a limited and narrow space, the user may feel inconvenience owing to the limited and narrow space. In addition, since a background image displayed on a monitor may not be synchronized with the sound outputted from the speaker, the user may feel bored. The speaker installed at a huge event concert is expensive and installed at multiple places, so that the monitors or screens showing images may be overlapped with the speakers. It is not easy to properly install multiple speakers and monitors in the limited spaces, so that it is impossible to maximize the event effects.

DISCLOSURE OF INVENTION

Accordingly, it is an object of the present invention to provide a speaker apparatus with a video screen function which overcomes the problems encountered in the conventional art.

It is another object of the present invention to provide a speaker apparatus with a video screen function that is able to overcome the problems occurring as a video apparatus and an audio apparatus are separately installed, by installing a speaker and a video screen at one integrated apparatus.

It is further another object of the present invention to provide a speaker apparatus with a video screen function which is able to give a maximized event effect to the user of a Karaoke room or a huge event by displaying an image and video source programmed to play depending on an audio output source selected by a user.

To achieve the above objects, in a speaker apparatus, which includes a sound output apparatus having a sound coil, a magnet and a damper, and an electric circuit apparatus of the sound output apparatus, there is provided an improved speaker apparatus which comprises a flexible OLED (Organic Light Emitting Device) for displaying a video source which synchronizes with an audio source outputted; an upgrade module, that includes a communication port and an internet terminal for externally receiving an upgrade video source; an inner memory that stores an audio source and a video source; a video/audio PCB chip that includes a memory for storing an upgrade video source inputted externally; a video source selector that selects a video source for displaying the stored video source or upgrade video; a video/audio source sync processor and a video signal processor for processing the video source displayed in synchronization with an audio source; and a video processor, a video buffer adjuster and a digital converter for allowing a video source outputted from the video signal processor to be displayed on the flexible OLED.

BRIEF DESCRIPTION OF THE DRAWINGS

The present invention will become better understood with reference to the accompanying drawings which are given only by way of illustration and thus are not limitative of the present invention, wherein.

BEST MODE FOR CARRYING OUT THE INVENTION

The preferred embodiments of the present invention will be described with reference to the accompanying drawings.

Figure 1:
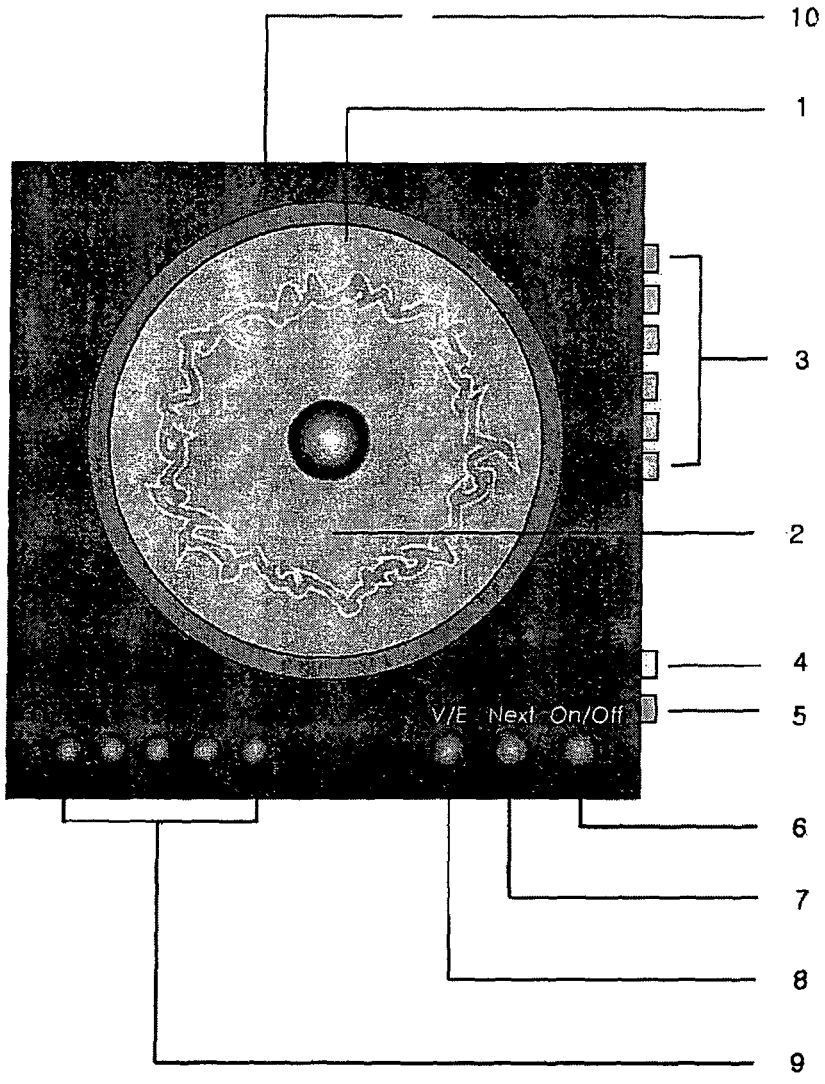
FIG. 1 is a view illustrating an outer look of a speaker apparatus according to the present invention.

FIG. 1 is a view illustrating an outer look of a speaker according to the present invention.

The speaker apparatus according to the present invention comprises a flexible OLED (Organic Lighting Emitting Device) 1, which substitutes a cone paper having an echo function in a conventional speaker or is attached on a cone paper for displaying a video source stored and an external video source, an upgrade module (USB, SD memory, etc) 3 for upgrading a video source from the outside, a terminal 4 for inputting an audio source, a terminal 5 for inputting a video source, a switch 6 for turning on/off the display of the flexible OLED, a switch 7 for displaying the stored next data of the video source displayed on the flexible OLED, a selection switch 8 for selecting the stored video source (for example, impact image) or an externally upgraded video source, and a memory shortcut key 9 for selecting a video source, which is preferred by a user, from the multiple video sources and displaying the same later.

The OLED 2 is a display device made of a glass. In recent years, as the technology is advanced, a flexible OLED is disclosed as a new display device which is made in a light thin film shape and is flexible enough for forming a circular shape. In the present invention, a flexible OLED, which may be used for a cone paper having a limited function in the conventional art, is installed at a speaker apparatus or is attached on a cone paper if necessary for thereby achieving the same function as the cone paper. So, it is possible to display various video images or video source in synchronization with the audio signal outputted.

The upgrade module 3, used for continuously receiving video sources externally, may be provided with a communication port or an internet terminal for using an external communication or an internet line for an upgrading method.

Figure 2:
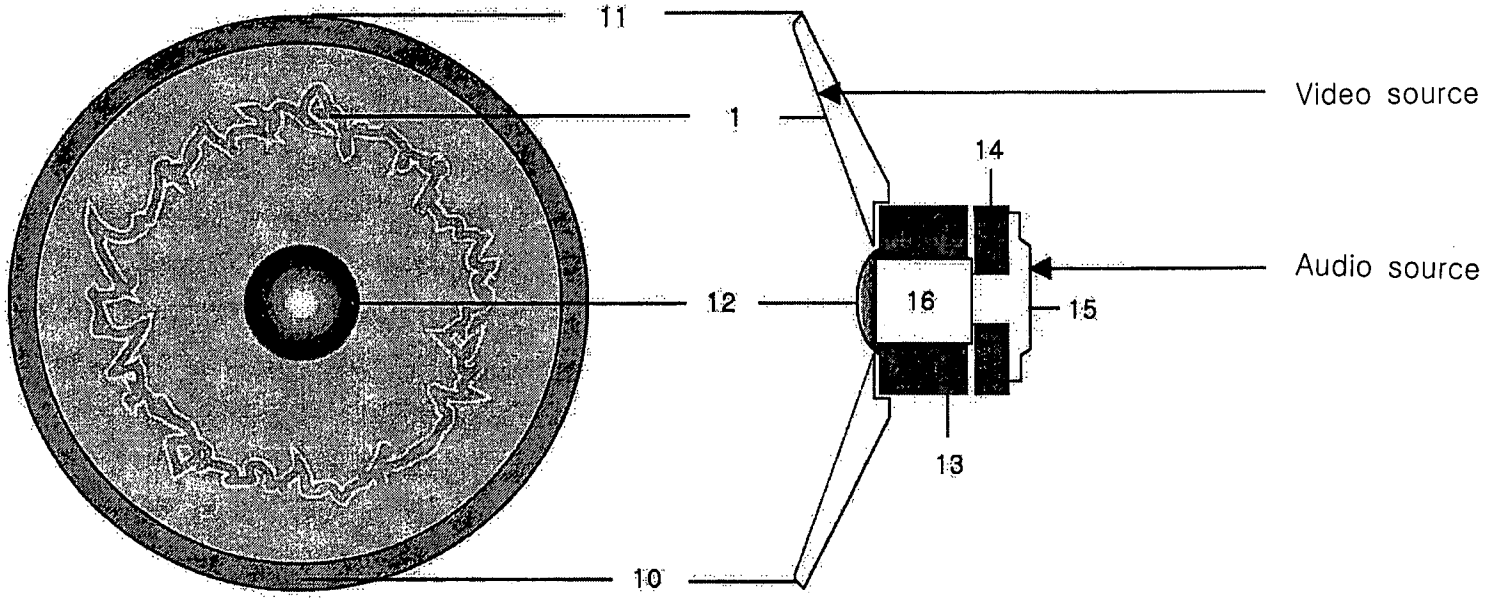
FIGS. 2 and 3 are views illustrating the major elements of a speaker apparatus according to the present invention.
Figure 3:
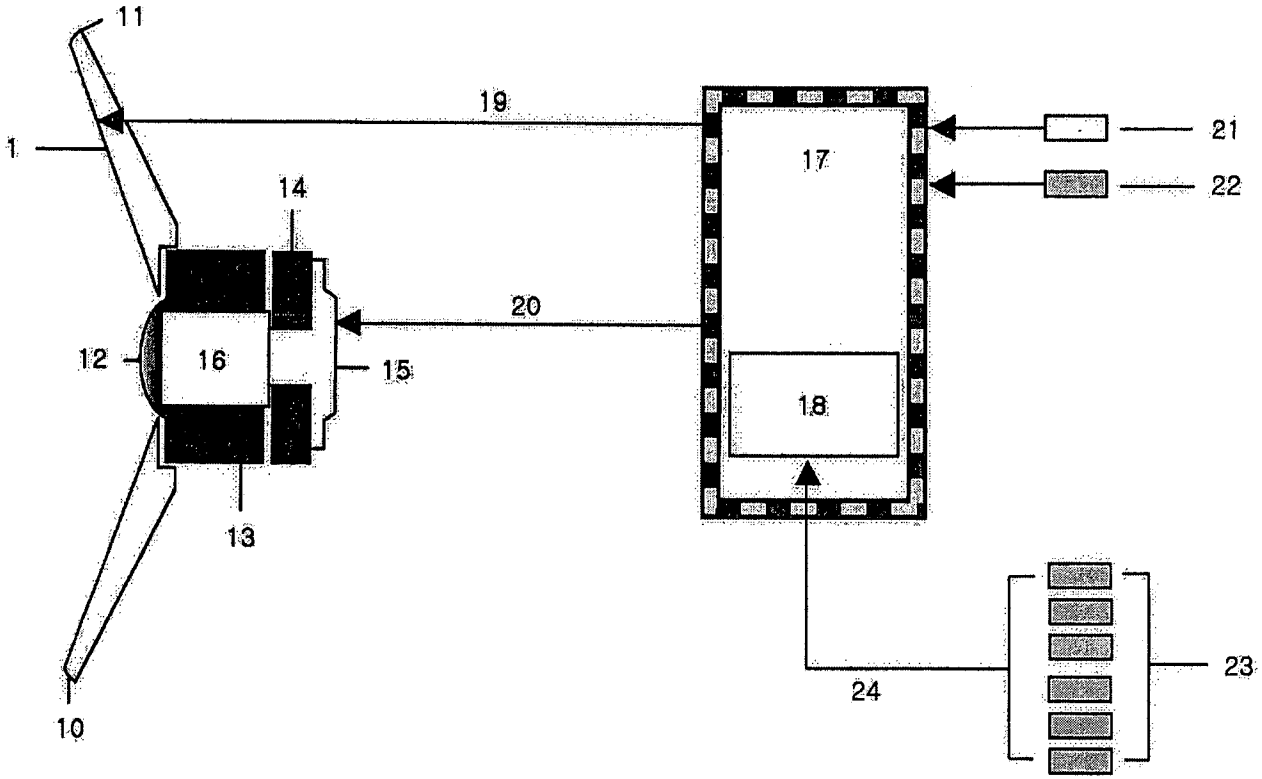

FIGS. 2 and 3 are views illustrating major elements of a speaker apparatus according to the present invention. As shown therein, there are provided a sound output apparatus formed of a sound coil 16, a magnet 14, a damper 13, a plate 15 and an outer cap 12, a flexible OLED 1 for displaying a video image or a video source, and an edge 10 and a gasket 11 which form an outer structure of the flexible OLED.

An audio source 21 and a video source 22 are inputted via a video/audio PCB chip 17, and the upgrade video source is inputted and stored into the memory 18 of the video/audio PCB chip via an external upgrade module (USB, SD memory, etc) 23. The video source 19 selected by the user among the above source is outputted and displayed on the OLED 1, and the audio source 20 is outputted from the audio apparatus.

Figure 4:
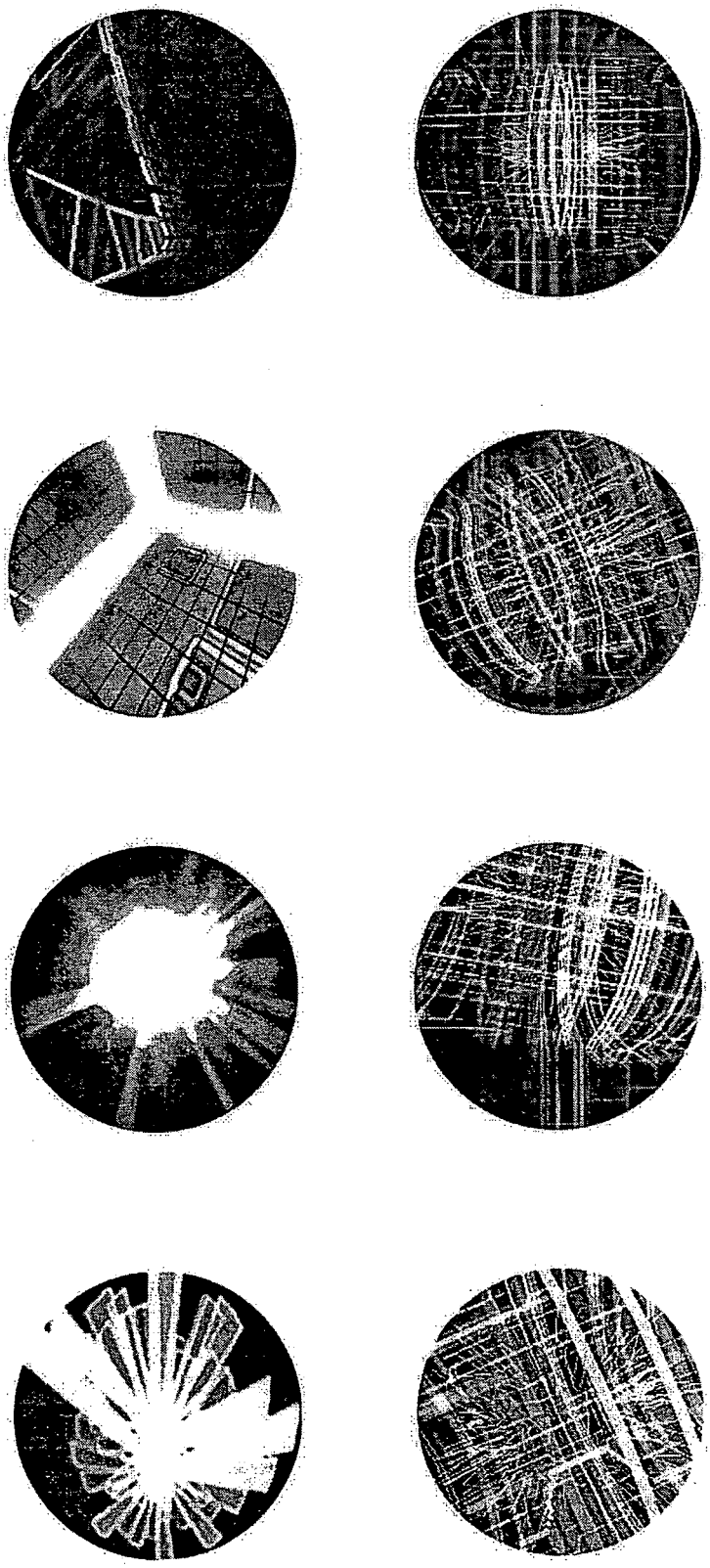
FIG. 4 is a view illustrating an example of an image displayed on a video screen of a speaker apparatus according to the present invention.

As shown in FIGS. 1 and 2, the video source displayed on the flexible OLED corresponds to an example of the impact images among the video sources. FIG. 4 shows an example of various types of impact images. The video sources displayed are programmed to synchronize with respect to an audio source outputted. Here, the user can select for allowing his preferred video source to react with a certain audio source. FIG. 4 shows only an example of the impact image. As shown therein, a common video or other video sources are displayed depending on a user's selection.

Figure 5:
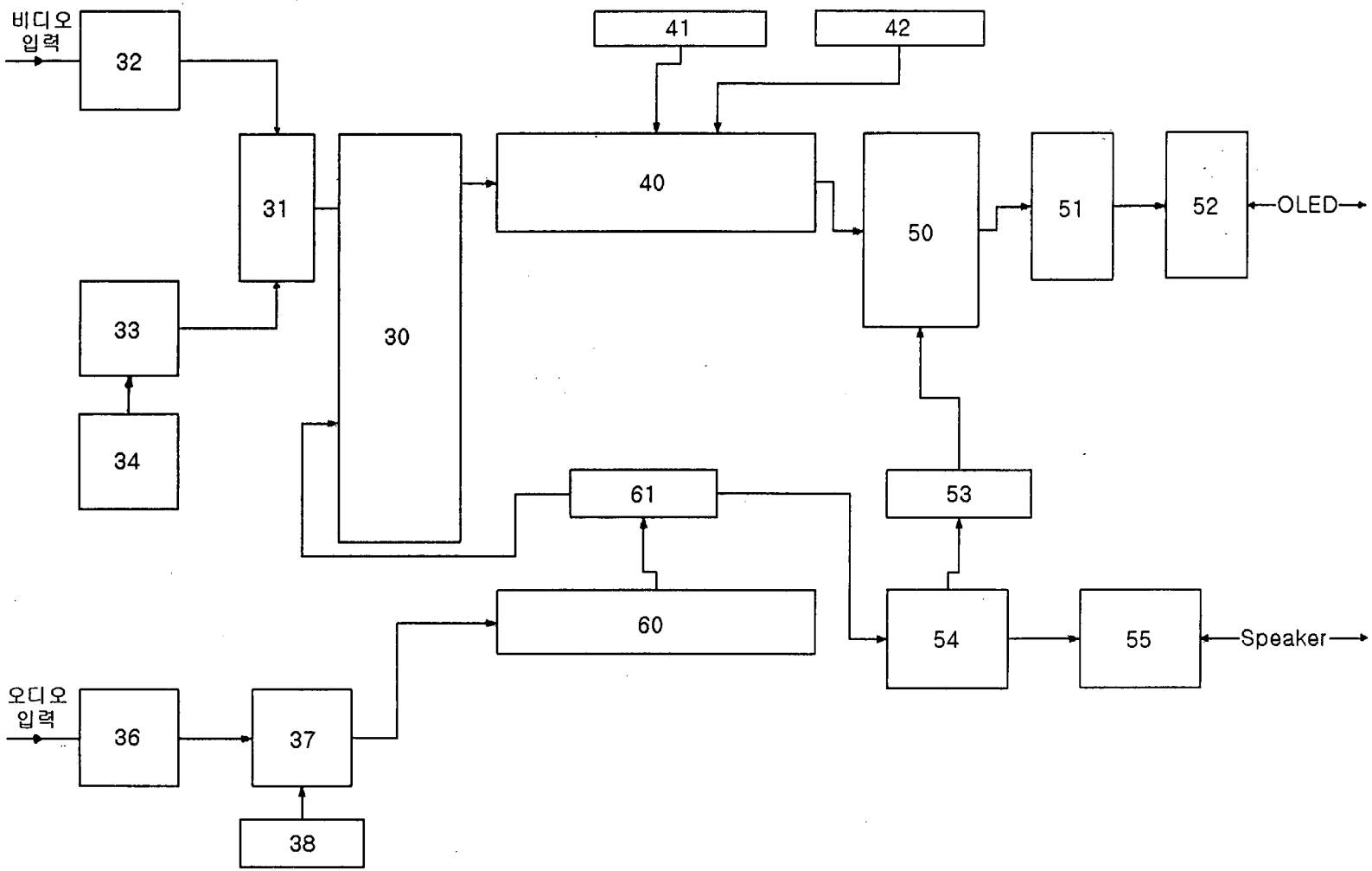
FIG. 5 is a block diagram of an inner circuit of a speaker apparatus according to the present invention.

FIG. 5 is a block diagram of major elements of an apparatus according to the present invention. The video source selected by the user between the video source stored in the inner memory 34 and an upgrade video source externally inputted is outputted from a video source selector 31 and is inputted into a video signal processor 40 via a video/audio sync processor 30.

The video source outputted from the video signal processor 40 is inputted into the flexible OLED via a video processor 50, a video buffer adjuster 51 and a digital converter 52 and is displayed thereon.

The audio source is inputted into the audio signal processor 60 via the audio input A/D converter 36 and an automatic gain adjuster 37 and is outputted from the speaker via a delay compensation circuit 61 and a D/A converter 54.

There is further provided a level detector 53 for indicating the level of an audio source in a visual video shape.

INDUSTRIAL APPLICABILITY

In the present invention, the flexible OLED having a function of a speaker and a video screen is installed at one apparatus, so that it is possible to prevent any inconvenience that occurs in a conventional system in which a video apparatus and an audio apparatus are separately provided, and the construction of the system is simplified. The video source selected by the user, which is programmed to react with respect to an audio output source is displayed on one apparatus, so that a user of a Karaoke room or an audience of an event may have an enhanced effect.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalents of such meets and bounds are therefore intended to be embraced by the appended claims.

The invention claimed is:

1. A speaker apparatus, which includes a sound output apparatus having a sound coil, a magnet and a damper, and an electric circuit apparatus of the sound output apparatus, the speaker apparatus, comprising: a flexible organic light emitting device substituted for a cone paper in a conventional speaker for displaying a video source, which synchronizes with an audio source output; an upgrade module, which includes a communication port and an internet terminal for externally receiving an upgrade video source; an inner memory, which stores an audio source and a video source; a video/audio PCB chip, which includes a memory for storing an upgrade video source input externally; a video source selector, which selects a video source for displaying the stored video source or upgrade video source; a video/audio source sync processor and a video signal processor for processing the video source displayed in synchronization with an audio source; and a video processor, a video buffer adjuster and a digital converter for allowing a video source output from the video signal processor to be displayed on the flexible organic light emitting device.

2. The apparatus of claim 1, further comprising: a video source selection switch for selecting a stored video source or an externally input upgrade video source; and a memory shortcut key for selecting a video source that a user prefers from the video sources.

3. The apparatus of claim 1, wherein the flexible organic light emitting device comprises a cone-shape.

4. The apparatus of claim 3, wherein the flexible organic light emitting device includes a central opening in alignment with the sound coil of the sound output apparatus.

5. The apparatus of claim 4, including an outer cap mounted to the sound output apparatus through the central opening to secure the flexible organic light emitting device to the sound output apparatus.

6. The apparatus of claim 1, wherein the flexible organic light emitting device includes a central opening.

7. A speaker apparatus with a video screen function comprising: a sound output apparatus having a sound coil, a magnet and a damper; an audio source for providing an audio source input; a video source for providing a video source input; a video/audio chip for receiving the audio source input and the video source input, the video/audio chip including a memory; and a circular cone-shaped flexible organic light emitting device for receiving the video source from the video/audio chip and displaying the video source synchronized with the audio source output provided by the video/audio chip to the sound output apparatus, and the circular cone-shaped flexible organic light emitting device outputting audio in combination with the sound output apparatus, further comprising: a video source selector for allowing a user to select a video source for display; a video/audio source sync processor and a video signal processor for processing the video source for display in synchronization with the audio source; and a video processor, a video buffer adjuster and a digital converter for allowing the video source output from the video signal processor to be displayed on the flexible organic light emitting device.

* * * * *